US006938667B2

(12) United States Patent
Sugiyama et al.

(10) Patent No.: US 6,938,667 B2
(45) Date of Patent: Sep. 6, 2005

(54) AUTOMATIC WIND-UP SCREEN DEVICE

(75) Inventors: Noboru Sugiyama, Shizuoka (JP); Takashi Aoki, Shizuoka (JP); Naoto Sawaguchi, Shizuoka (JP); Takeshi Aoyama, Shizuoka (JP)

(73) Assignee: Seiki Juko Co., Ltd., Shizuoka (JP)

( * ) Notice: Subject to any disclaimer, the term of this patent is extended or adjusted under 35 U.S.C. 154(b) by 0 days.

(21) Appl. No.: 10/494,034

(22) PCT Filed: Oct. 7, 2003

(86) PCT No.: PCT/JP03/12822

§ 371 (c)(1),
(2), (4) Date: May 7, 2004

(87) PCT Pub. No.: WO2004/031525

PCT Pub. Date: Apr. 15, 2004

(65) Prior Publication Data

US 2004/0261958 A1 Dec. 30, 2004

(30) Foreign Application Priority Data

Oct. 7, 2002 (JP) ..... 2002-294104
May 26, 2003 (JP) ..... 2003-147915

(51) Int. Cl.[7] ..... E06B 9/56
(52) U.S. Cl. ..... 160/296; 160/302
(58) Field of Search ..... 160/296, 302, 160/291, 292, 301, 313, 323.1, 23.1, 31, 8

(56) References Cited

U.S. PATENT DOCUMENTS 471,467 A * 3/1892 Crisson ..... 160/263
4,466,475 A * 8/1984 Saito et al. ..... 160/297
4,513,805 A * 4/1985 Mase ..... 160/299
4,535,829 A * 8/1985 Fukuchi ..... 160/291
4,662,423 A * 5/1987 Ishii ..... 160/293.1
4,838,333 A * 6/1989 Mottura ..... 160/305
5,542,464 A * 8/1996 Shiina ..... 160/296
5,634,507 A * 6/1997 Kwoka ..... 160/310
6,155,328 A * 12/2000 Welfonder ..... 160/313
6,378,594 B1 * 4/2002 Yamanaka et al. ..... 160/238
6,591,890 B1 * 7/2003 Grubb et al. ..... 160/296
6,629,555 B2 * 10/2003 DeBlock et al. ..... 160/31

FOREIGN PATENT DOCUMENTS

| | | |
|---|---|---|
| EP | 922 831 | 6/1999 |
| JP | 10-306667 | 11/1998 |
| JP | 10-306668 | 11/1998 |
| JP | 2000-27570 | 1/2000 |
| JP | 2000-337057 | 12/2000 |

* cited by examiner

*Primary Examiner*—David Purol
(74) *Attorney, Agent, or Firm*—Oblon, Spivak, McClelland, Maier & Neustadt, P.C.

(57) ABSTRACT

An automatic winding screen device has a coil spring fixed to a bracket at one end of a winding box, the other end of the coil spring being fixed to a winding shaft, and a damper for alleviating impact and collision noise. Between the damper on a shaft fixed to the winding box and the winding shaft, a one-way clutch mechanism is interposed such that, when the winding shaft is rotated in a screen deploying direction, the connection between the damper and the winding shaft is cancelled while when the winding shaft rotates in a screen winding direction the damper is connected to the winding shaft.

13 Claims, 9 Drawing Sheets

AUTOMATIC WIND-UP SCREEN DEVICE

TECHNICAL FIELD

The present invention relates to an automatic winding screen device for dust-blocking, light exclusion, thermal insulation, and insect blocking, and more specifically it relates to an automatic winding screen device using a rotational urging force due to the swinging of a coil spring housed within a winding shaft as a power source for winding the screen and having a damper for absorbing impact and collision noise produced during winding with the coil spring.

BACKGROUND ART

A screen device has been widely known in that a screen is wound around a winding shaft having a coil spring as a power source while an open/close operation frame is attached at the extremity of the screen for automatically winding the screen.

In such an automatic winding-up screen device, the screen is wound by a rotational urging force due to the swinging of a coil spring, so that the winding speed is increased upon completion of the winding, and the operation frame attached to the extremity of the screen produces a large impact upon colliding with a winding box, making a large collision sound. In order to minimize this problem, a damper is normally provided to control the increase in winding speed (see, for example, Japanese Unexamined Patent Application Publication No. 2003-106076).

In the damper of this conventional screen device, the rotational force of the winding shaft is always transmitted to the damper regardless of the rotational direction of the winding shaft. By use of a one-way clutch housed in the damper, a damper resistance is applied when the screen is wound around the winding shaft, while no resistance is applied when pulling the screen down.

However, since the one-way clutch houses the damper, when the winding shaft is rotated in the direction to pull down the screen, a slight resistance is still applied to the screen retracting operation. For example, in the case of an oil damper, there is frictional resistance between a rubber seal to prevent oil from leaking and a shaft penetrating the seal, thereby making it more difficult to pull down the screen.

Also, since the damper is designed to reduce the winding force of the coil spring for winding the screen, the winding force is significantly reduced when wind is acted on the screen, for example, in comparison with devices without dampers, so that pulling down the screen may be difficult to be conducted depending on the circumstances.

SUMMARY OF INVENTION

It is a technical object of the present invention to provide an automatic winding screen device in that around a winding shaft having a coil spring as a power source, a screen is wound so as to automatically wind the screen, and even if a damper is provided for absorbing impact and collision noise produced during winding, the operationality is improved by reducing the resistance when pulling down the screen as much as possible.

It is another technical object of the present invention to provide an automatic winding screen device in which a force generated by the coil spring for winding the screen is effectively operated by disabling the damper up to a point where the winding speed is reduced, which point may be arbitrarily established.

It is another technical object of the present invention to provide an automatic winding screen device capable of simply adjusting the time when the winding speed is reduced.

It is another technical object of the present invention to provide an automatic winding screen device in that regardless of the amount of screen delpoyment, a damper braking force is applied within a predetermined range at the late phase of storing the screen in cases when the screen frame is accidentally released by mistake halfway when the screen is being pulled down.

In order to solve the problems described above, an automatic winding screen device according to the present invention includes a winding box to which the winding shaft is rotatably supported, the coil spring being fixed to a bracket at one end of the winding box; a spring support seat fixed to the winding shaft so as to prevent rotation, the other end of the coil spring being attached to the spring support seat; a fixed shaft fixed to the bracket of the winding box; and a damper disposed between the fixed shaft and the winding shaft for applying a braking force to the winding shaft, wherein on the fixed shaft, a one-way clutch mechanism is interposed between the damper and the winding shaft, the one-way clutch disconnecting the connection between the damper and the winding shaft when the screen is pulled down against the rotational urging force of the coil spring while making the connection at least at a later stage of winding when the winding shaft rotates in a direction winding the screen therearound.

In such an automatic winding screen device, since the one-way clutch mechanism is provided between the damper on the shaft fixed to the winding box and the winding shaft connecting the damper to the winding shaft, when the screen is wound so that the rotation of the winding shaft is not transmitted to the damper with the one-way clutch mechanism, upon deploying the screen, a frictional resistance force within the damper is not applied thereto, reducing the resistance so that the screen can be further developed as compared to a conventional case where the clutch mechanism is housed in the damper.

The one-way clutch mechanism in the automatic winding screen device may include a damper-side clutch piece disposed in the shaft fixed to the winding box with the damper therebetween and a winding shaft-side clutch piece rotatably fitted into a support shaft disposed in the damper-side clutch piece, the winding shaft-side clutch piece rotating integrally with the winding shaft and also slidable along the axial direction of the winding shaft. Between both clutch pieces, clutch teeth may be provided, the clutch teeth being disengaged when the winding shaft is rotated to deploy the screen while being engaged to each other when the winding shaft is rotated in the opposite direction. Urging means may also be provided for urging the winding shaft-side clutch piece toward the damper-side clutch piece to an extent that both clutch teeth are mated with each other, thus simplifying the structure of the one-way clutch mechanism.

Also, the one-way clutch mechanism may include a damper-side clutch piece disposed in the shaft fixed to the winding box with the damper therebetween and a winding shaft-side clutch piece connected to a support shaft disposed in the damper-side clutch piece with a spirally operating mechanism therebetween, the winding shaft-side clutch piece being rotating integrally with the winding shaft and also slidable along the axial direction of the winding shaft. In this case, the spirally operating mechanism may be structured so that the winding shaft-side clutch piece rotates about the support shaft, the winding shaft-side clutch piece being driven in a direction away from the damper-side clutch piece following the rotation of the winding shaft when deploying the screen while being driven in a direction approaching the damper-side clutch piece when the winding shaft is rotated in a direction winding the screen therearound. In addition, both clutch pieces may be provided with clutch teeth which are mated with each other when the clutch pieces are abutted to each other.

In this case, a braking force due to the damper is applied to the winding shaft at an arbitrary time and a force winding the screen due to the coil spring is not reduced by the braking force until a time when the screen is effectively operated.

The spirally operating mechanism may use screws mated with each other and respectively disposed in the support shaft on the damper-side clutch piece and in the winding shaft-side clutch piece; however, the mechanism is not limited to this structure, and a thread groove and an extrusion element such as a pin may be used, for example.

In the automatic winding screen device according to one of the preferred embodiments of the present invention, the spirally operating mechanism disposed between the winding shaft-side clutch piece and the support shaft is configured to drive the winding shaft-side clutch piece in a direction approaching the damper-side clutch piece from the start of the screen winding process until the time that the damper is operated by the mutual connection of the clutch pieces so as to start reducing the speed of the screen, and wherein on the support shaft, an idling region is provided for idling the winding shaft-side clutch piece relative to the support shaft in situ when the winding shaft-side clutch piece exceeds an operational range of the spirally operating mechanism during deployment of the screen. In this case, urging means may be provided for urging the winding shaft-side clutch piece disposed in the idling region on the support shaft to the spirally operating mechanism.

Furthermore, the standing depth of the support shaft is adjustable relative to the damper-side clutch piece so that a time that the damper starts operating is made adjustable.

Also, the one-way clutch mechanism may include a damper-side clutch piece disposed in the shaft fixed to the winding box with the damper therebetween, a winding shaft-side clutch piece rotating integrally with the winding shaft and also slidable along the axial direction of the winding shaft, a clutch spring for urging both the clutch pieces in a mating direction, and clutch time-difference operating means for maintaining connection of both the clutch pieces while the winding shaft rotates by a predetermined number of rotations from a full wound state when the screen is opened, and then for separating both the clutch pieces apart against an urging force of the clutch spring.

In this case, the one-way clutch mechanism may include the damper-side clutch piece and the winding shaft-side clutch piece rotating integrally with the winding shaft and also slidable along the axial direction of the winding shaft and having a female threads on an internal periphery. The mechanism may also include a movement member having a male threads formed on an external periphery so as to mate with the female threads, the movement member being slidable on the fixed shaft in the axial direction and also sliding while being restricted from rotation, and a clutch spring for urging the movement member toward the damper.

The clutch time-difference operating means may include a movement member movable relative to the winding shaft-side clutch piece in the axial direction of the fixed shaft so as to rotate the clutch piece and the movement member integrally with the winding shaft and also slidably in the axial direction and a clutch spring interposed therebetween so as to connect the movement member to the fixed shaft via a spirally operating mechanism. In this case, the spirally operating mechanism may be driven in a direction that the movement member separates from the damper in a state that both the clutch pieces are mated with each other during initial predetermined rotations when the winding shaft is rotated in a direction deploying the screen, and after the predetermined number of rotations, the spirally operating mechanism may be driven in a direction that the winding shaft-side clutch piece and the movement member are integrally moved in a direction approaching the damper-side clutch piece, while when the winding shaft is driven in a direction that the screen is wound, the spirally operating mechanism may be driven in a direction that the winding shaft-side clutch piece and the movement member integrally approach the damper-side clutch piece, and after the predetermined number of rotations and after both the clutch pieces are mated with each other, only the movement member may be driven in a direction approaching the damper-side clutch piece.

In these cases, between the fixed shaft disposed in the bracket of the winding box and the spring support seat disposed in the winding shaft, the coil spring may be provided for winding the screen so as to make adjustable the rotational urging force of the coil spring by the rotation of the fixed shaft relative to the bracket while the damper is provided between the fixed shaft and the winding shaft. As such, the spirally operating mechanism disposed between the movement member and the fixed shaft may be able to drive the winding shaft-side clutch piece toward the damper-side clutch piece from when the screen winding process starts until the time that the damper is operated by the mutual connection of the clutch pieces so as to start reducing the speed of the screen. In addition, on the support shaft, an idling region may be provided for idling the winding shaft-side clutch piece relative to the support shaft in situ when the winding shaft-side clutch piece exceeds an operational range of the spirally operating mechanism during deployment or unrolling of the screen.

As described above, according to the automatic winding screen device of the present invention, even if a damper is provided for absorbing impact and collision noise produced during winding, the operationality is improved by making the resistance during screen deployment as small as possible. Also, by controlling the engagement timing of the damper, which may be arbitrarily established, the winding force due to the coil spring may also be effectively operated.

Also, the one-way clutch mechanism may include a damper-side clutch piece disposed in the shaft fixed to the winding boy; with the damper therebetween, a winding shaft-side clutch piece rotating integrally with the winding shaft and also slidable along the axial direction of the winding shaft, a clutch spring for urging both the clutch pieces in a mating direction, and clutch time-difference operating means for maintaining connection of both clutch pieces during the rotation of the winding shaft by a predetermined number of rotations from a full wound state when the screen is opened, and then for separating both clutch pieces apart against an urging force of the clutch spring, so that regardless of the amount of screen deployment, and damper braking force can be effectively operated only within a predetermined range at the late phase of storing the screen. Therefore, not only operationality is improved by reducing a resistance during screen deployment, but also a coil spring winding force can be effectively operated during the winding. Moreover, in a case where an operational frame is released by mistake when the screen is partially deployed, the damper braking force can be effectively operated, so that a large impact and large collision noise are not produced when the operation frame collides with the winding box, thereby also preventing unwanted accidents, such as when fingers are pinched between the operation frame and the winding box. Accordingly, an automatic winding screen device with improved operationality and safety can be provided.

DETAILED DESCRIPTION OF THE INVENTION

Embodiments of an automatic winding screen device according to the present invention will be described in detail below with reference to the drawings.

Figure 1:
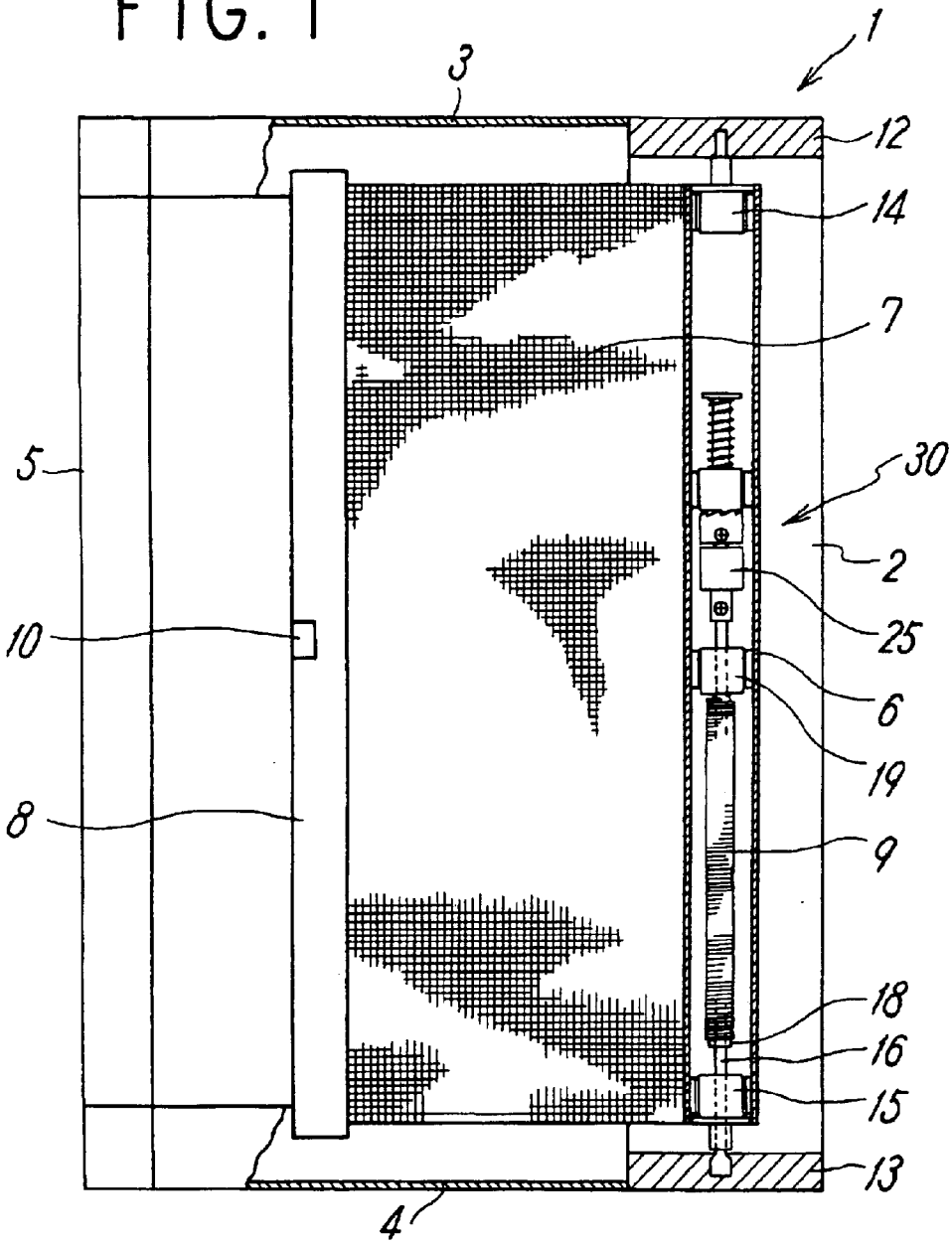
FIG. 1 is a front partially broken sectional view of an automatic winding screen device according to a first embodiment of the present invention.
Figure 2:
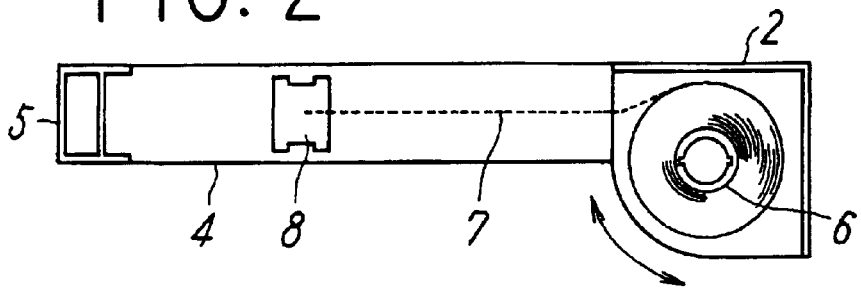
FIG. 2 is a sectional plan view of the automatic winding screen device.

FIGS. 1 and 2 schematically show the entire structure of a first embodiment of an automatic winding screen device according to the present invention, wherein a horizontal pulling screen is exemplified as a screen device; however, the present invention is not limited to the horizontal pulling screen and may also incorporate a case where a vertical pulling screen is automatically wound upward.

Also, the screen device is shown as being applied for light exclusion, thermal insulation, and insect blocking in an opening of a building; however, it is not limited to these applications and it may also be applied to a dust-blocking screen of a front surface of a shelf and an opening of a meal serving wagon for distributing meals.

The screen device shown in FIGS. 1 and 2 includes a screen frame 1 provided in an opening of a building, and one side frame 2 of the screen frame 1 is constructed of a winding box supporting a rotatable winding shaft 6 for winding a screen 7 therearound. The screen frame 1 includes upper and lower frames 3 and 4 respectively connected to upper and lower ends of the side frame 2 and the other side frame 5 opposing the side frame 2, which are connected to each other. The winding shaft 6 within the winding box constituting the side frame 2 houses a coil spring 9. The screen 7 is automatically opened using a rotational urging force the coil spring 9 as a power source winding the screen. An operation frame 8 is attached at the extremity of the screen 7 for open/close operation so that a fitting 10 disposed in the operation frame 8 is engaged with the side frame 5 during deployment or unrolling of the screen 7 so as to maintain the screen 7 at a stretched state. Also, upper and lower ends of the screen 7 and the operation frame 8 are guided with the upper and lower frames 3 and 4.

Both ends of the winding shaft 6 are rotatably supported to brackets 12 and 13 at upper and lower ends of the winding box via support members 14 and 15, respectively, and a fixed shaft 16 fixed to the lower bracket 13 at an end is inserted into the inside of the winding shaft 6. One end of a coil spring 9 is wound around and fixed to a spring support seat 18 while the other end of the coil spring 9 is rotatably attached to the fixed shaft 16 and also fixedly attached to a spring support seat 19 fixed to the winding shaft 6. Therefore, the winding shaft 6 of the screen 7 is connected to the fixed shaft 16 via the coil spring 9.

Figure 3:
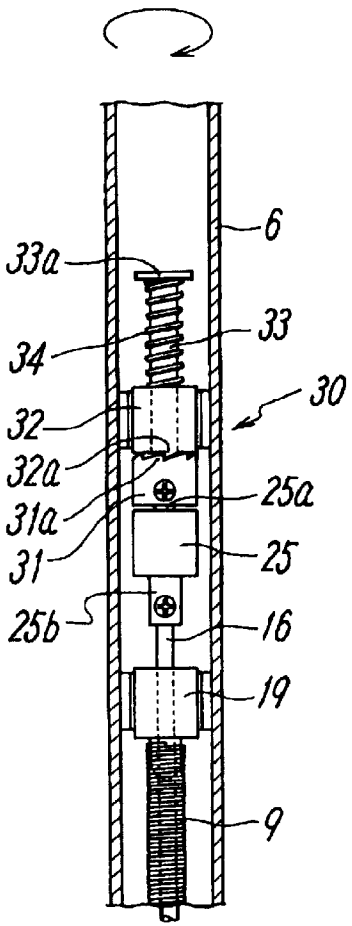
FIG. 3 is a sectional view of a winding shaft according to the first embodiment in a state that a damper is operated (when a screen is wound).
Figure 4:
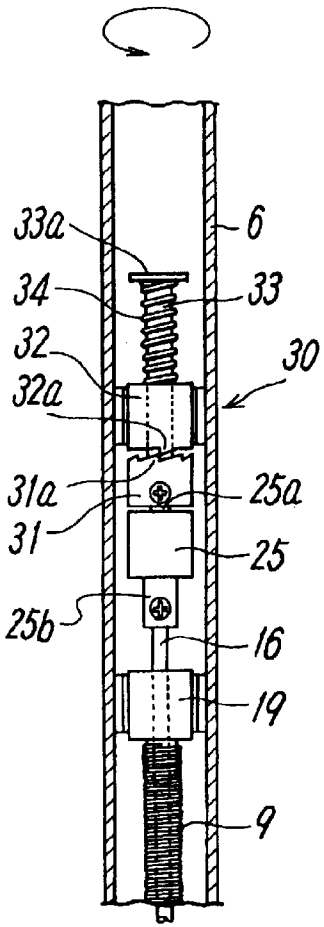
FIG. 4 is a sectional view of the winding shaft according to the first embodiment in a state that the damper is not operated (when the screen is being deployed).

As shown in FIGS. 3 and 4 in detail, the fixed shaft 16 is provided with an oil damper 25 attached at one end, and between a rotation shaft 25*a* of the oil damper and the winding shaft 6, a one-way clutch mechanism 30 is provided.

In the one-way clutch mechanism 30, when the winding shaft 6 is rotated in a direction deploying the screen 7 against the rotational urging force of the coil spring 9, the connection between the oil damper 25 and the winding shaft 6 is automatically cancelled; whereas when the winding shaft 6 rotates in a direction winding the screen 7 by the urging force of the coil spring 9, the oil damper 25 is connected to the winding shaft 6.

Specifically, the one-way clutch mechanism 30 includes a damper-side clutch piece 31 connected to a rotational shaft 25*a* of the mechanism 30 and a winding shaft-side clutch piece 32 rotatably inserted into a support shaft 33 disposed in the damper-side clutch piece 31, the winding shaft-side clutch piece 32 rotating integrally with the winding shaft 6 and also being slidable along the axial direction of the winding shaft 6. Between both the clutch pieces 31 and 32, clutch teeth 31*a* and 32*a* are provided, which are not mated with each other when the winding shaft 6 is rotated in a direction to deploy the screen 7 while are mated with each other when the winding shaft 6 rotates in a direction retracting the screen 7.

Between a flange 33*a* at the extremity of a support shaft 33 and the clutch piece 32, a spring 34 is provided as urging means for urging the winding shaft-side clutch piece 32 to the damper-side clutch piece 31 to an extent that both the clutch teeth 31*a* and 32*a* are mated with each other. The spring 34 may be one in that the clutch piece 32 always abuts the clutch piece 31 even when the screen device shown in FIG. 1 is arranged upside down. In addition, if the weight of the clutch piece 32 in the state in FIG. 1 is sufficient for always pushing the clutch piece 31, the spring 34 may also be omitted as the urging means.

The oil damper 25 connects a connection part 25*b* of a casing to the fixed shaft 16 so as to connect the connection part 25*b* to a braking cylinder rotatably accommodated in the casing via viscous fluid for deriving the rotation shaft 25*a* through a cover of the casing; however, it is not limited to this and various known structures may be adopted. According to the first embodiment shown in the drawings, the connection part 25*b* to the casing of the damper 25 is connected to the fixed shaft 16 while the rotation shaft 25*a* of the damper 25 is connected to the clutch piece 31; however, the connection may be the reverse thereto.

In the automatic winding screen device structured as above, between the damper 25 on the fixed shaft 16 fixed to the winding box and the winding shaft 6, the one-way clutch mechanism 30 is provided for connecting between the damper 25 and the winding shaft 6 when the screen 7 is wound while the one-way clutch mechanism 30 does not connect the rotation of the winding shaft 6 to the damper 25 when the screen 7 is deployed as shown in FIG. 4. Therefore, upon deploying the screen 7, a resistance force due to friction within the damper 25 is not applied thereto, making the resistance during deployment of the screen 7 as small as possible, so that the effort to deploy the screen of this invention is significantly reduced compared to screen a conventional screen where the one-way clutch mechanism is housed in the damper.

When the screen 7 is wound by a rotational urging force stored in the coil spring 9, as shown in FIG. 3, the one-way clutch mechanism 30 engages the winding shaft 6 to the fixed shaft 16 via the damper 25, so that, although the winding shaft 6 is rotated by the coil spring 9, an increase in winding speed is suppressed by damper 25, preventing large impacts and collision noise when the operation frame 8 collides with the winding box.

Figure 5:
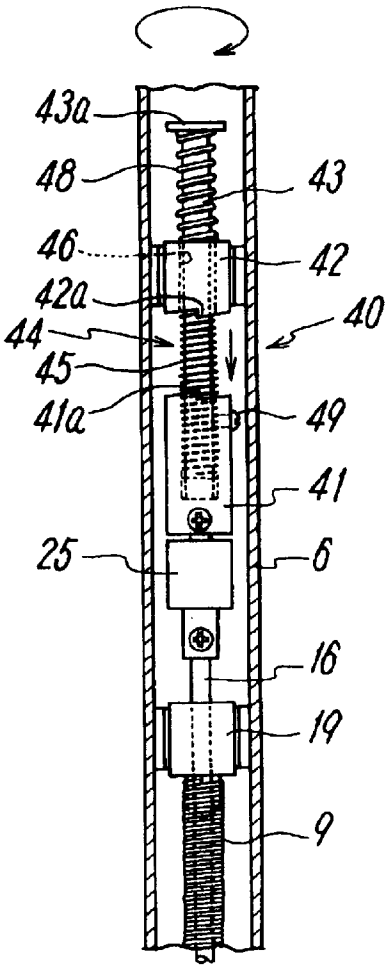
FIG. 5 is a sectional view of a winding shaft according to a second embodiment upon starting to move a winding shaft-side clutch piece by screwing (starting to wind the screen).
Figure 6:
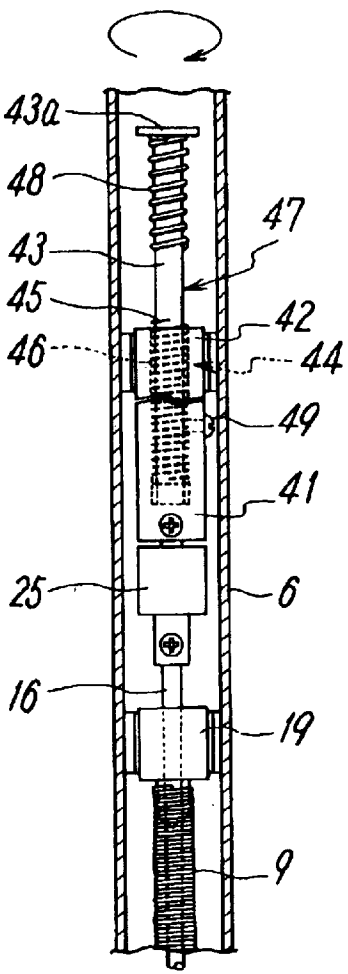
FIG. 6 is a sectional view of the winding shaft according to the second embodiment in a state that a damper is operated.
Figure 7:
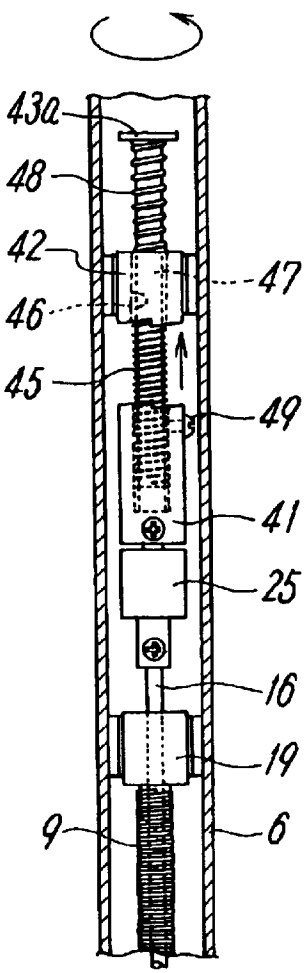
FIG. 7 is a sectional view of the winding shaft according to the second embodiment when the screen is deployed.

FIGS. 5 to 7 show operational manners of the essential part of a second embodiment according to the present invention. Since the entire structure according to the second embodiment other than a one-way clutch mechanism is substantially the same as that of the first embodiment described with reference to FIGS. 1 and 2, in the description of the second embodiment below, like reference numerals shown in the drawings designate like elements common to the first embodiment, and duplicated description is omitted.

A one-way clutch mechanism 40 according to the second embodiment, in the same way as in the first embodiment, includes a damper-side clutch piece 41 connected to the fixed shaft 16 fixed to the bracket 13 of the winding box via the damper 25 and a winding shaft-side clutch piece 42 connected to a support shaft 43 disposed in the damper-side clutch piece 41 via a spirally operating mechanism 44, the winding shaft-side clutch piece 42 rotating integrally with the winding shaft 6 and also being slidable along the axial direction of the winding shaft 6. The damper 25 itself is the same as described in the first embodiment before.

Between both the clutch pieces 41 and 42, clutch teeth 41*a* and 42*a* are provided, preferably which are not mated with each other when the winding shaft 6 is rotated in a direction deploying the screen 7 while are mated with each other when the winding shaft 6 rotates in a direction winding the screen 7. However, it is not necessarily to have such a structure and it may have a structure for transmitting the rotation by the pressing in contact with each other.

The spirally operating mechanism 44, as shown in the drawings, may be composed of a male screw 45 and a female screw 46 respectively provided in both the support shaft 43 on the damper-side clutch piece 41 and the winding shaft-side clutch piece 42. Alternatively, it may use a thread groove formed on one of the support shaft 43 and the clutch piece 42 and a projection such as a pin disposed on and fitted into the other, for example. The mechanism may be sufficient that the winding shaft-side clutch piece 42 rotates about the support shaft 43 so as to be driven in a direction separating from the damper-side clutch piece 41 following the rotation of the clutch piece 42 when the winding shaft 6 rotates in a direction deploying the screen 7 while is driven in a direction approaching the clutch piece 41 when the winding shaft 6 is rotated in a direction winding the screen 7.

In the spirally operating mechanism 44 disposed between the clutch piece 42 and the support shaft 43 according to the second embodiment shown in the drawings, the screen winding amount from starting to the point when the winding speed is reduced, i.e., when the damper 25 is operated by the mutual connection of the clutch pieces 41 and 42, is established by the length of the male screw 45, while the winding shaft-side clutch piece 42 is driven (screwed) in a direction approaching the damper-side clutch piece 41. FIG. 5 shows the state in that the screen 7 starts to be wound around the winding shaft 6; and FIG. 6 shows the state in that the damper 25 starts to be operated by the mutual connection of the clutch pieces 41 and 42.

In such a manner, since the screen winding amount from starting to the point when the winding speed is reduced as established by the length of the male screw 45, which prevents the damper 25 from being operated, so that even when an eternal force such as wind is applied to the screen, the screen 7 can be wound using the strong winding force of the coil spring 9.

Also, when the winding shaft 6 rotates in a screen deployment direction, as shown in FIG. 7, the clutch piece 42 is moved in a direction separating from the clutch piece 41 so as to cancel the connection between the clutch pieces 41 and 42, so that the rotation of the winding shaft 6 cannot be transmitted to the oil damper 25, and the screen 7 can be normally deployed.

When the screen 7 is further deployed, or unrolled, so that the clutch piece 42 exceeds the operational range of the spirally operating mechanism 44, i.e., when the female threads 46 of the clutch piece 42 engaged to the male screw 45 exceeds the range of the male screw 45, there is provided an idling region 47 (see FIG. 6) at the end of a threading range of the male screw 45 on the support shaft 43 for idling the clutch piece 42 in situ relative to the support shaft 43. The threading range of the male screw 45 should be within a range that the female threads 46 of the clutch piece 42 moves from the complete deployment state to the operating state point for the damper 25 by the mutual connection of the pair of clutch pieces 41 and 42 during the winding of the screen 7 around the winding shaft 6. When a screen device having a difference in length of the screen 7 also incorporates the invention, the length difference is absorbed in the idling region 47.

As urging means for urging the clutch piece 42 located in the idling region 47 on the support shaft 43 toward the male screw 45, a spring 48 is provided between a flange 43*a* at the extremity of the support shaft 43 and the clutch piece 42. The structure and operation of the spring 48 is substantially the same as those of the spring 34 according to the first embodiment, so that the description is omitted.

The damper-side clutch piece 41 is provided with the support shaft 43 vertically studded by screwing, so that the studded position is fixed with a fastening element 49 such as a set screw. The studded depth of the support shaft can be freely adjusted by changing the studded depth of the support shaft 43 after removing the fastening element 49. Thereby, the length of the male screw 45 is changed so that the time for operating the oil damper 25 can be adjusted.

Figure 8:
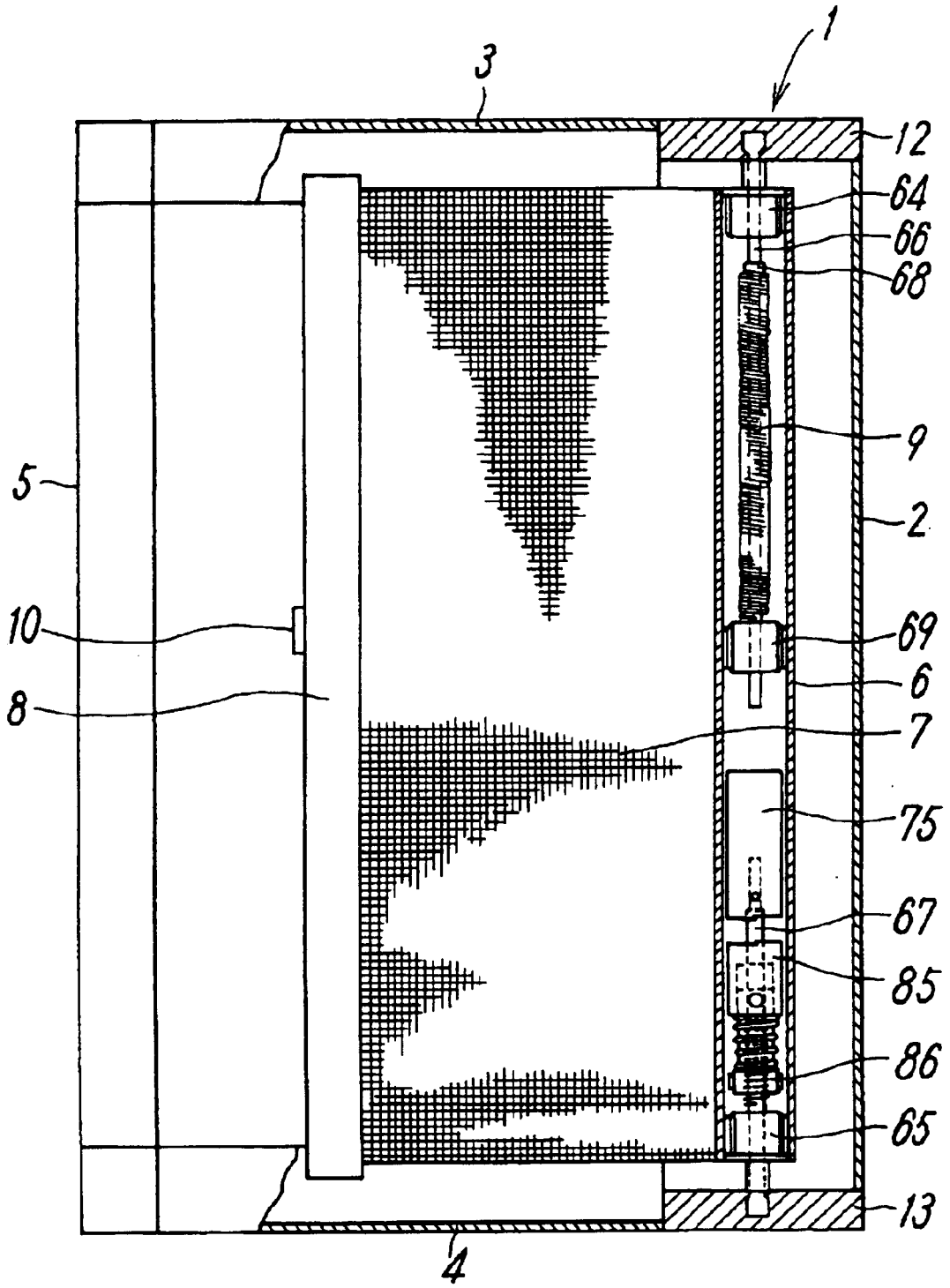
FIG. 8 is a front partially broken sectional view of an automatic winding screen device according to a third embodiment of the present invention.

FIG. 8 schematically shows the entire structure of an automatic winding screen device according to a third embodiment of the present invention. Since the entire structure other than an internal structure of the winding shaft 6 is the same as that of the first embodiment, like reference numerals designate like elements common or equivalent to the first embodiment, and the description is omitted.

In the screen device according to the third embodiment, both ends of the winding shaft 6 are rotatably supported by the brackets 12 and 13 at upper and lower ends of the winding box via support members 64 and 65, respectively, and a fixed shaft 66 fixed to the upper bracket 12 at an end is inserted into the inside of the winding shaft 6 while a fixed shaft 67 fixed to the lower bracket 13 at an end is inserted thereinto. Then, one end of the coil spring 9 is wound around and fixed to a spring support seat 68 while the other end of the coil spring 9 is rotatably attached to the fixed shaft 66, and the winding shaft 6 is fixedly attached to a spring support seat 69. Therefore, the winding shaft 6 of the screen 7 is connected to the fixed shaft 66 via the coil spring 9.

As shown in FIGS. 9 to 12 in detail, at the extremity of the fixed shaft 67, an oil damper 75 is provided while a one way clutch mechanism 80 is provided between a rotation shaft 75*a* of the oil damper 75 and the winding shaft 6.

In the one-way clutch mechanism 80, when the winding shaft 6 is rotated in a direction developing the screen 7 against the rotational urging force of the coil spring 9, the connection between the damper 75 and the winding shaft 6 is automatically cancelled; whereas when the winding shaft 6 rotates in a direction winding the screen 7 by the urging force of the coil spring 9, the damper 75 is connected to the winding shaft 6.

In more detail, the one-way clutch mechanism 80 includes a damper-side clutch piece 81 arranged in the fixed shaft 67, which is fixed to the winding box, with the oil damper 75 therebetween and a winding shaft-side clutch piece 85 rotating integrally with the winding shaft 6. The clutch mechanism 80 is also capable of being slidable along the axial direction of the winding shaft 6 and includes a clutch spring 84 for urging both the clutch pieces 81 and 85 in a mating direction and a clutch member 82 constituting clutch time-difference operating means for maintaining the connection of both the clutch pieces 81 and 85 while the winding shaft 6 rotates by a predetermined number of rotations from a full wound state when the screen is opened, and then for separating both the clutch pieces 81 and 85 apart against an urging force of the clutch spring 84.

The clutch member 82 includes the winding shaft-side clutch piece 85 and a movement member 86 movable relative to the clutch piece 85 in the axial direction of the fixed shaft 67. The movement member 86 is provided with a female thread 86*b* formed on the internal periphery of a flange 86*a* at the base end, and a spirally operating mechanism 87 is constructed by mating the female threads with a male screw 67*a* formed on the fixed shaft 67 so as to enable the movement member 86 to move relative to the clutch piece 85 in the axial direction of the fixed shaft 67. The movement member 86 and the clutch piece 85 are fitted and inserted with each other by spline-fitting a convex portion 86*c* disposed at an end of the movement member 86 adjacent to the clutch piece 81 into a groove 85*b* disposed in the clutch piece 85. By providing a stopper 85*c* abutting the convex portion 86*c* of the movement member 86 at an end of the clutch piece 85 opposite to the clutch piece 81, the clutch piece 85 and the movement member 86 are rotated integrally with the winding shaft 6, and in the axial direction of the winding shaft 6, the convex portion 86*c* of the movement member 86 is slidable in the groove 85*b* of the clutch piece 85.

Between both the clutch pieces 81 and 85, clutch teeth 81*a* and 85*a* are provided, which are not mated when the winding shaft 6 is rotated in a screen deploying direction, while being engaged with each other when the winding shaft 6 rotates in a screen winding direction.

As urging means for urging the clutch piece 85 in the winding shaft-side clutch member 82 to the damper-side clutch piece 81 so that both the clutch teeth 81*a* and 85*a* are mated with each other, between the flange 86*a* at the extremity of the movement member 86 and the clutch piece 85, a clutch spring 84 is provided. The clutch spring 84 may be one in that the clutch piece 85 always abuts the clutch piece 81 even when the screen device shown in FIG. 8 is arranged upside down.

Figure 9:
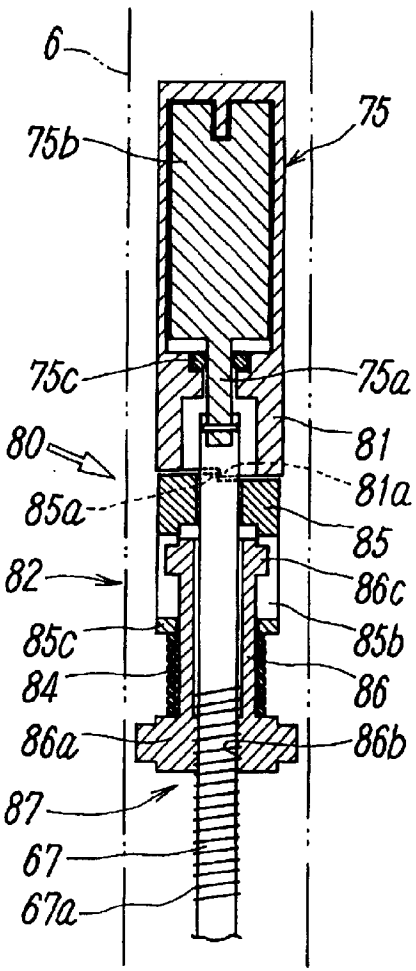
FIG. 9 is an enlarged sectional view of a winding shaft according to the third embodiment in a state that a damper is operated (a movement member is started to move relative to a clutch piece).
Figure 10:
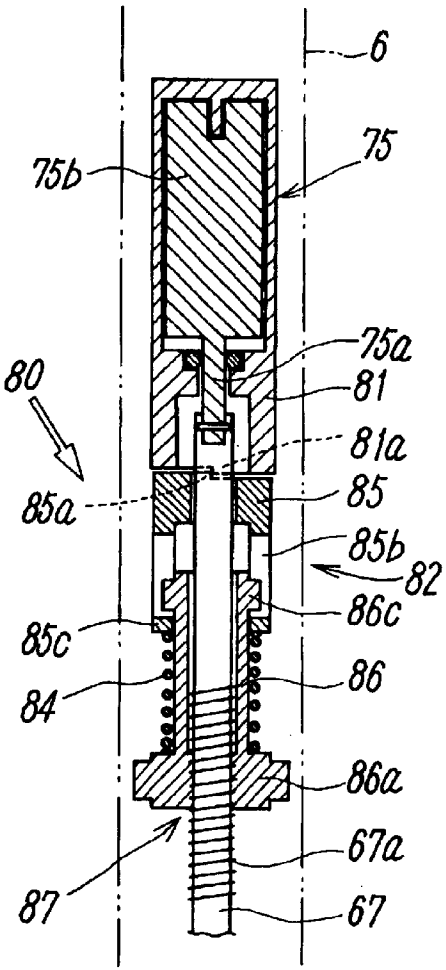
FIG. 10 is an enlarged sectional view of the winding shaft according to the third embodiment in a state that the damper is operated (the movement member is moving relative to the clutch piece).

In the spirally operating mechanism 87, the winding shaft-side clutch member 82 rotates about the fixed shaft 67, and during initial predetermined rotations when the winding shaft 6 is rotated in a screen deploying direction, the clutch tooth 85*a* of the winding shaft-side clutch piece 85 slides relative to the clutch tooth 81*a* of the damper-side clutch piece 81, and only the movement member 86 is driven away from the damper 75 (FIGS. 9 and 10). After the predetermined number of rotations and the convex portion 86*c* of the movement member 86 arrives the stopper 85*c* of the clutch piece 85, the clutch piece 85 and the movement member 86 are integrally driven away from the damper 75 (FIGS. 11 and 12).

Figure 11:
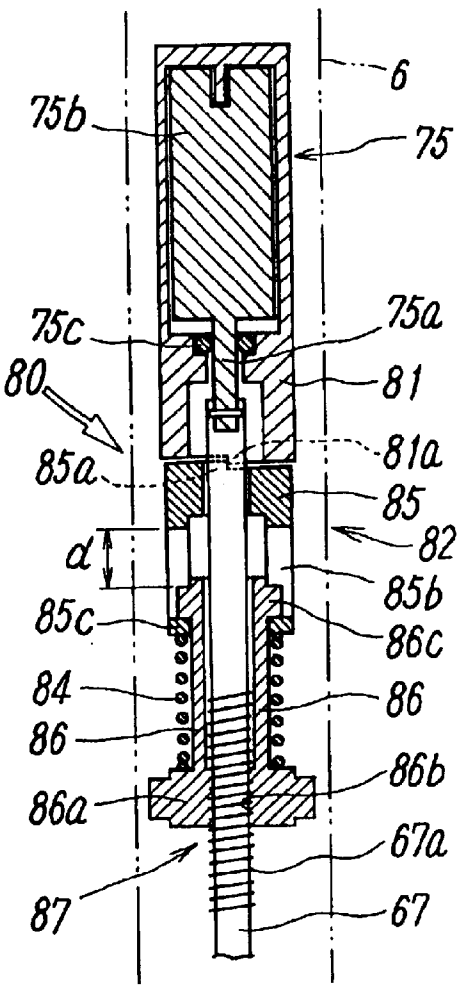
FIG. 11 is an enlarged sectional view of the winding shaft according to the third embodiment in a state that the damper is operated (the movement member is stopped relative to the clutch piece).
Figure 12:
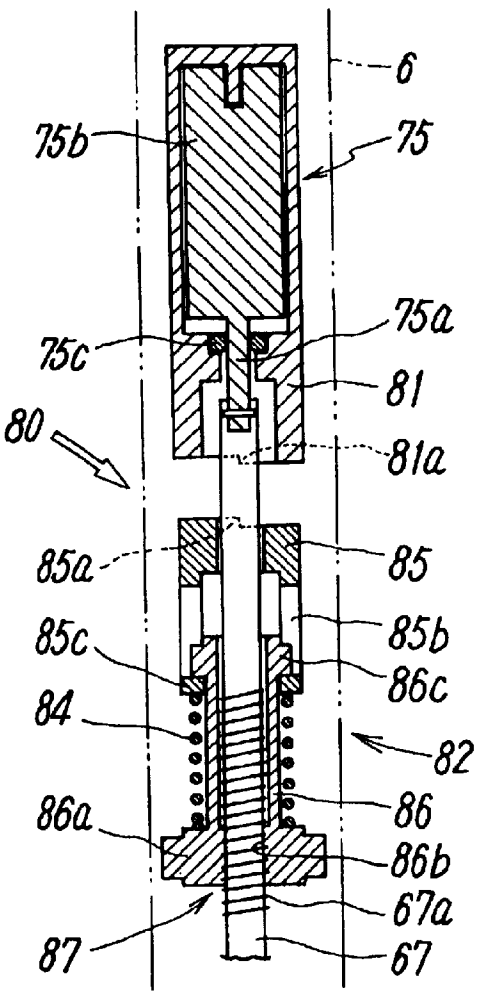
FIG. 12 is an enlarged sectional view of the winding shaft according to the third embodiment in a state that the damper is not operated.

In contrast, when the winding shaft 6 rotates in a screen winding direction, the clutch piece 85 of the clutch member 82 and the movement member 86 are integrally driven toward the damper-side clutch piece 81 (FIGS. 12 and 11). Once the clutch tooth 85*a* of the winding shaft-side clutch member 82 and the clutch tooth 81*a* of the damper-side clutch piece 81 are mated with each other, the movement member 86 is driven toward the damper-side clutch piece 81 (FIGS. 9 to 11). Meanwhile, the rotation of the winding shaft 6 is transmitted to the casing of the oil damper 75 via the movement member 86, the clutch piece 85, and the clutch piece 81 mated with the clutch piece 85. Since the rotation shaft 75*a* of the oil damper 75 is fixed to the bracket 13 of the winding box by the fixed shaft 67, the damper 75 applies a braking force to the winding shaft 6.

As is understood from the description above, the spirally operating mechanism 87 disposed between the movement member 86 and the fixed shaft 67 moves the movement member 86 relative to the fixed shaft 67 away from the damper 75 during screen deployment until the movement member 86 is moved by the distance d shown in FIG. 11. Subsequently, the mechanism 87 engages with the clutch piece 85 so as to also move the clutch piece 85 in the same direction. Therefore, during winding the screen 7, when the clutch piece 85 is not separated from the clutch piece 81 (FIGS. 10 and 11), the clutch pieces 81 and 85 are simultaneously connected together so as to operate the damper 75. When both the clutch pieces 81 and 85 are separated from each other (FIG. 12), the movement member 86 is moved toward the damper 75 when winding the screen together with the clutch piece 85, and after the clutch piece 85 abuts the clutch piece 81, the damper 75 is operated until the screen winding process is complete, i.e., during displacement of the movement member 86 by the distance d.

The damper 75 includes a braking cylinder 75*b* rotatably accommodated within the clutch piece 81 constituting the casing with viscous fluid therebetween and a rotation shaft 75*a* extending from one end of the braking cylinder 75*b* so as to be derived from the casing with a sealing member 75*c* therebetween. The end of the rotation shaft 75*a* is connected to one end of the fixed shaft 67. However, the structure is not limited to this, and known various structures may be adopted.

In the automatic winding screen device structured as above, between the damper 75 on the fixed shaft 67 fixed to the winding box and the winding shaft 6, the one-way clutch mechanism 80 is provided, which connects the damper 75 to the winding shaft 6 during winding the screen 7; during deployment of the screen 7, as shown in FIGS. 9 to 12, the rotation of the winding shaft 6 is not transmitted to the damper 75 by the one-way clutch mechanism 80, so that a frictional resistance force within the damper 75 is not applied during screen deployment, thereby making screen deployment resistance as small as possible. Therefore, it is easier to deploy the screen of the instant invention as compared to a conventional screen where the one-way clutch mechanism is housed in the damper.

When the screen 7 is wound by the coil spring 9, as shown in FIGS. 9 to 11, the one-way clutch mechanism 80 connects the winding shaft 6 to the fixed shaft 67 via the damper 75 during several rotations just before a complete retraction of the screen 7, so that although the winding shaft 6 is rotated by the rotational urging force of the coil spring 9, an increase in the rotation speed is suppressed by the buffer power of the damper 75, preventing large impact and large collision noise from being produced when the operation frame 8 collides with the winding box.

Moreover, since regardless of the amount of deployment of the screen 7, a braking force due to the damper 75 is applied only within a predetermined range at the late phase of storing the screen 7, by reducing the resistance during deployment of the screen 7, not only the screen's operationality is improved but also the winding force of the coil spring 9 can be effectively operated during the winding. Therefore, large impact and large collision noise are not produced when the operation frame 8 collides with the winding box, but also an unwanted accident may be prevented, such as when fingers are pinched between the operation frame 8 and the winding box, so that the operationality and safety can be further improved more than those of a conventional automatic winding screen device.

Figure 13:
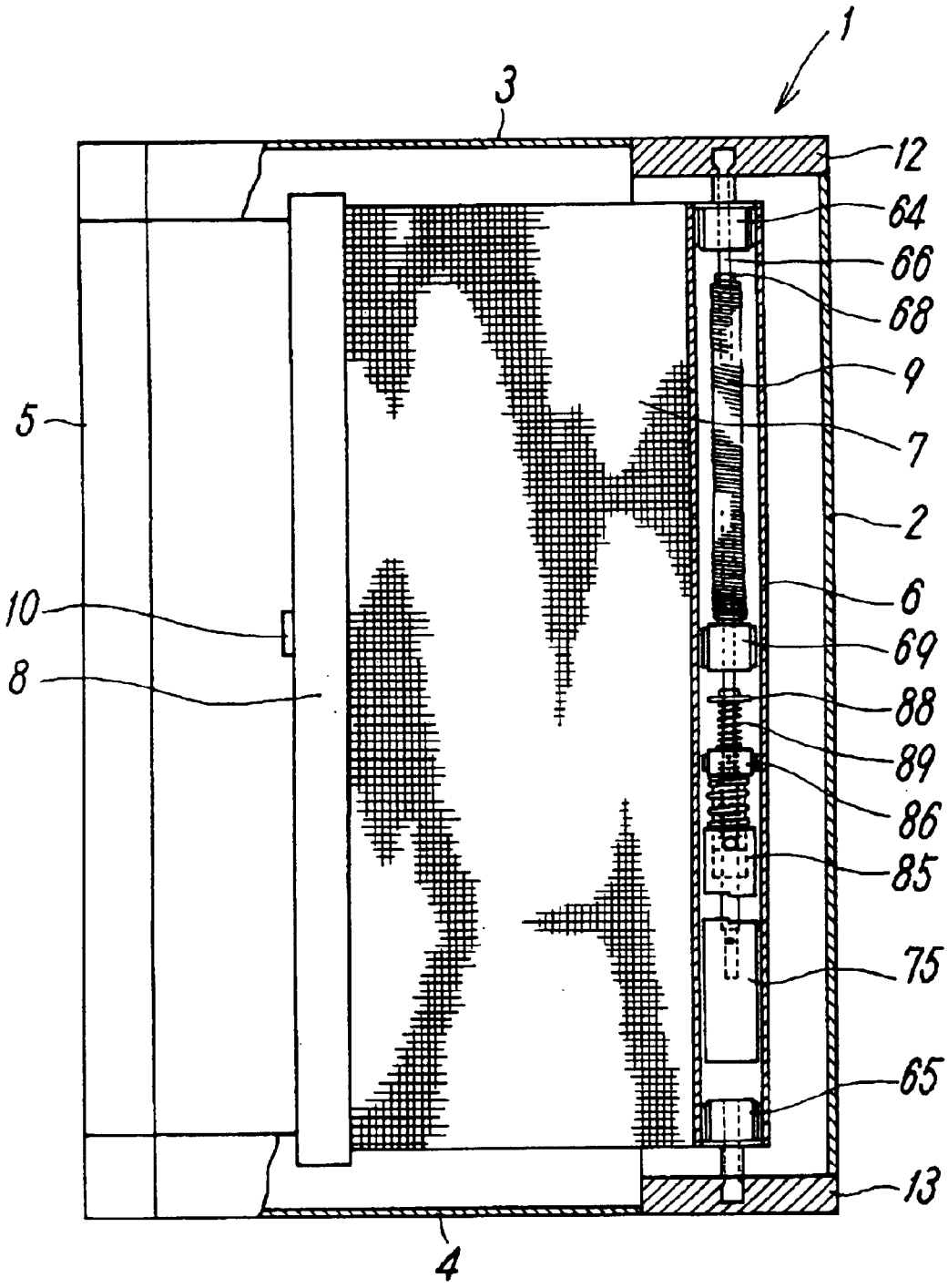
FIG. 13 is a front partially broken sectional view of a fourth embodiment according to the present invention when a winding shaft-side clutch piece begins to move by screwing (starting to wind the screen).
Figure 14:
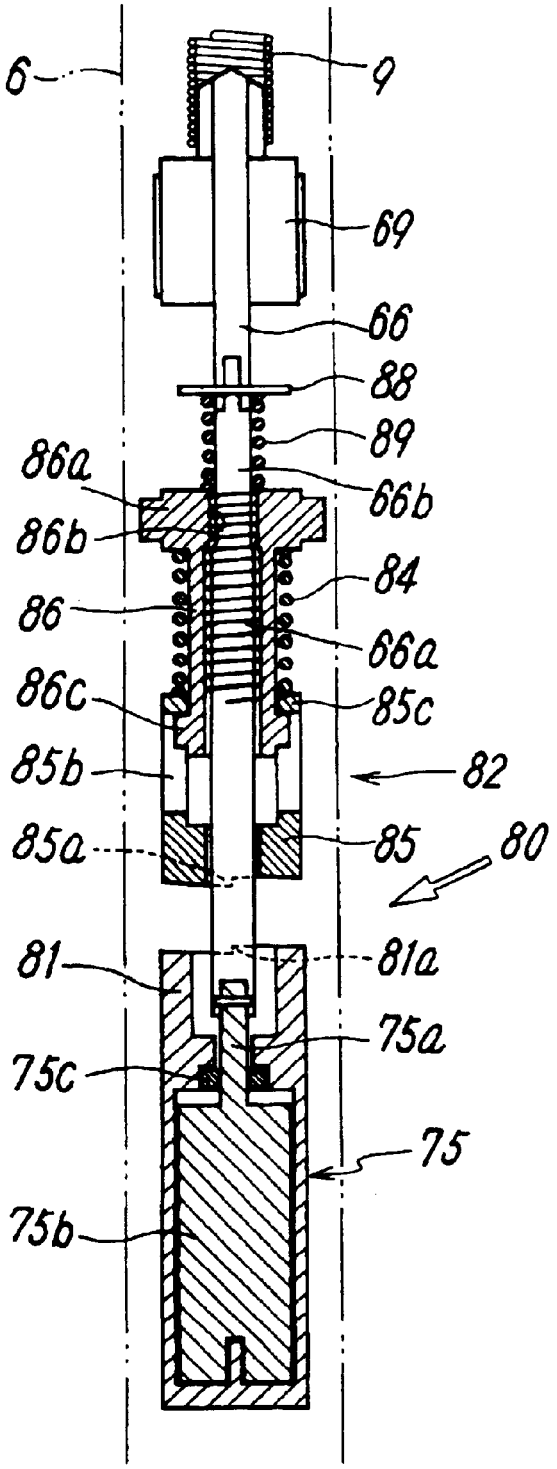
FIG. 14 is an enlarged sectional view of the winding shaft according to the fourth embodiment.

FIGS. 13 and 14 show a fourth embodiment according to the present invention.

An automatic winding screen device according to the fourth embodiment integrally includes the coil spring 9 as a power source for winding the screen 7 and the fixed shaft 66 in that an end of part of the one-way clutch mechanism is fixed to the bracket 12 disposed at the upper end of the winding box.

In addition, since the principal structure of the one-way clutch mechanism according to the fourth embodiment is substantially the same as that of the third embodiment described with reference to FIG. 8, in the description of the fourth embodiment below, like reference numerals shown in the drawings designate like elements common to the third embodiment, and duplicated description is omitted.

In the automatic winding screen device according to the fourth embodiment, both ends of the winding shaft 6 are rotatably supported to the brackets 12 and 13 of the winding box via the support members 64 and 65, respectively, and the fixed shaft 66 fixed to the upper bracket 12 at an end is inserted into the inside of the winding shaft 6. Then, one end of the coil spring 9 is wound around and fixed to the spring support seat 68 while the other end of the coil spring 9 is rotatably attached to the fixed shaft 66, and the integrally rotatable spring support seat 69 is fixedly fixed to the winding shaft 6. Therefore, the winding shaft 6 of the screen 7 is connected to the fixed shaft 66 via the coil spring 9. The fixed shaft 66 can be fixed to the bracket of the winding box in an arbitrarily rotating state using known means provided for adjusting the rotational urging force of the coil spring 9.

As shown in FIG. 14 in detail, at one end of the fixed shaft 66, the damper 75 is provided, and between the rotation shaft 75*a* of the damper 75 and the winding shaft 6, the one-way clutch mechanism 80 is provided.

The one-way clutch mechanism 80 includes the damper-side clutch piece 81 arranged in the fixed shaft 67, which is fixed to the winding box, with the oil damper 75 therebetween and the winding shaft-side clutch piece 85 rotating integrally with the winding shaft 6 and also being slidable along the axial direction of the winding shaft 6. The mechanism 80 also includes the clutch spring 84 for urging both the clutch pieces 81 and 85 in a direction mating each other and the clutch member 82 constituting the clutch time-difference operating means for maintaining the connection of both the clutch pieces 81 and 85 while the winding shaft 6 rotates by a predetermined number of rotations from a full wound state when the screen 7 is opened, and then for separating both the clutch pieces 81 and 85 apart against an urging force of the clutch spring 84.

For adjusting the rotational urging force of the coil spring 9, the fixed shaft 66 is appropriately rotated so that the movement member 86 is changed in position on a male screw 66*a* on the fixed shaft 66. When the screen 7 is continued to develop so that the movement member 86 in the clutch piece 82 exceeds the operational range of the spirally operating mechanism 87, i.e., when a female thread 86*b* of the movement member 86 screwed to the male screw 66*a* engraved in the fixed shaft 66 exceeds the range of the male screw 66*a*, there is provided an idling region 66*b* at the end of a threading range of the male screw 66*a* on the fixed shaft 66 for idling the movement member 86 in situ relative to the fixed shaft 66. The threading range of the male screw 66*a* is required to be within a range that the female thread 86*b* of the movement member 86 moves from the complete developed state to starting to operate the damper 75 by the mutual connection of the pair of clutch pieces 81 and 85 by the way during the winding of the screen 7 around the winding shaft 6. When a screen device having a difference in length of the screen 7 also incorporates the invention, the length difference is absorbed in the idling region 66*b*.

As urging means for urging the movement member 86 in the clutch member 82 disposed in the idling region 66*b* on the fixed shaft 66 toward the male screw 66*a*, a spring 89 is provided between a spring seat 88 disposed on the fixed shaft 66 and the movement member 86. The spring 89 may be sufficient to push the female threads 86*b* of the movement member 86 to the male screw 66*a* of the fixed shaft 66 to an extent capable of mating them together when the winding shaft 6 is rotated in a screen winding direction. In addition, if the weight of the movement member 86 (the clutch member 82) in the deployment state illustrated in FIG. 14 is sufficient for always pushing the male screw 66*a* of the fixed shaft 66, the spring 89 may also be omitted as the urging means.

The other structures and operations of the automatic winding screen device according to the fourth embodiment are substantially the same as those according to the third embodiment, so that like reference numerals designate like element common or equivalent thereto, and the description is omitted.

Figure 15:
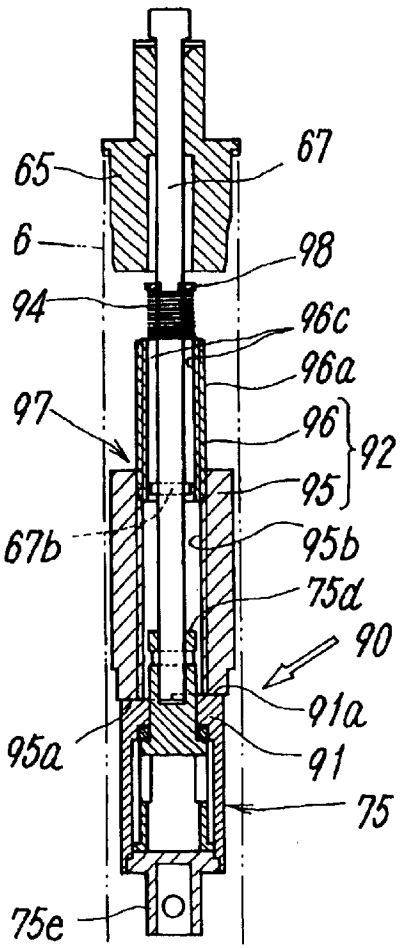
FIG. 15 is a front partially broken sectional view of a one-way clutch mechanism according to a fifth embodiment in a state that the screen is entirely wound.
Figure 16:
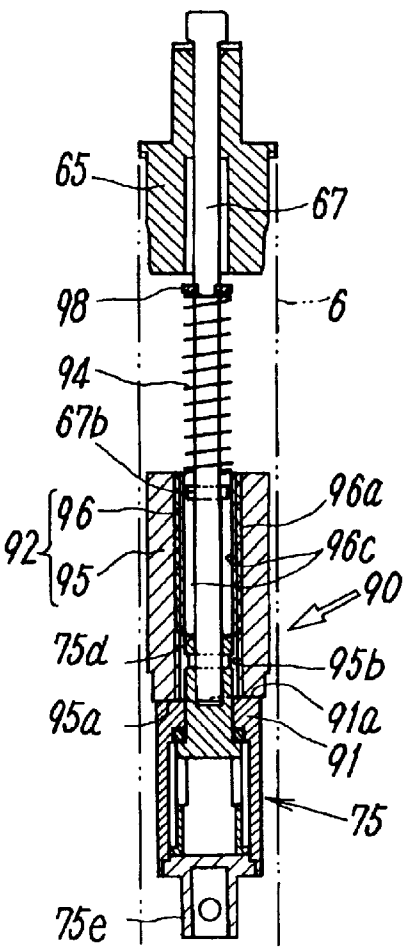
FIG. 16 is a front partially broken sectional view of the fifth embodiment in a state that when a winding shaft-side clutch piece is separated from a damper-side clutch piece.
Figure 17:
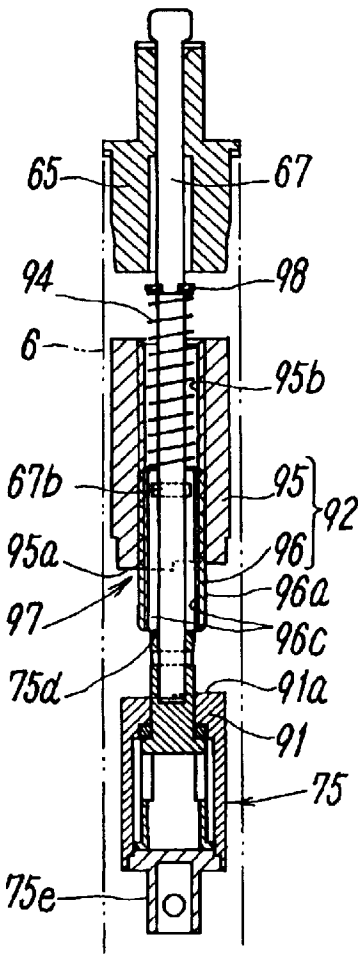
FIG. 17 is a front partially broken sectional view of the fifth embodiment upon completion of the movement of the winding shaft-side clutch piece (completion of deployment of the screen).

FIGS. 15 to 17 show a fifth embodiment according to the present invention.

An automatic winding screen device according to the fifth embodiment includes a damper-side clutch piece 91 and a winding shaft-side clutch piece 95 having a female threads 95*b* engraved on the internal periphery, the winding shaft-side clutch piece 95 rotating integrally with the winding shaft 6 and also being slidable along the axial direction of the winding shaft 6, as a one-way clutch mechanism 90. The screen device also includes a clutch member 92 constituting clutch time-difference operating means having a screw 96*a* mated to the female threads 95*b* on the external periphery and a movement member 96 slidable in the axial direction of the fixed shaft 67 and a clutch spring 94 for urging the movement member 96 to the damper.

Since the principal structure according to the fifth embodiment other than a one-way clutch mechanism is substantially the same as that of the third embodiment described with reference to FIG. 8, in the description of the fifth embodiment below, like reference numerals shown in the drawings designate like elements common to the third embodiment, and duplicated description is omitted.

In the description of the fifth embodiment in more detail, the clutch member 92, as described above, includes the winding shaft-side clutch piece 95 having the female threads 95*b* engraved on the internal periphery and the movement member 96 movable relative to the clutch piece 95 in the axial direction of the fixed shaft 67, and wherein a spirally operating mechanism 97 is constructed by mating the male screw 96*a* formed on the external periphery of the movement member 96 with the female screw 95*b* formed on the internal periphery of the winding shaft-side clutch piece 95. As is understood from FIGS. 15 to 17, the movement member 96 is movable relative to the clutch piece 95 in the axial direction of the fixed shaft 67, and both ends of a pin 67*b* penetrated into the fixed shaft 67 in a direction perpendicular to the axial direction are inserted into grooves 96*c* and 96*c* formed on the internal periphery so as to oppose each other, so that the movement member 96 is inserted and fitted into the clutch piece 95 slidably in the axial direction and in a state the rotation is restricted by the fixed shaft 67.

As urging means for urging the winding shaft-side clutch piece 95 to the damper-side clutch piece 91 to an extent that both clutch teeth 91*a* and 95*a* are mated each other, a clutch spring 94 is provided between an end of the winding shaft 6 in the movement member 96 adjacent to the support member 95 and the spring support seat 68 disposed on the fixed shaft 67. The clutch spring 94 may be sufficient to always mate the clutch piece 95 with the clutch piece 91 by pushing even when the screen device is arranged upside down.

In the spirally operating mechanism 97, when the winding shaft 6 is rotated in a direction developing the screen 7 from the full-wound state shown in FIG. 15, and during initial predetermined rotations toward the state shown in FIG. 16, the clutch tooth 95*a* of the winding shaft-side clutch piece 95 slides relative to the clutch tooth 91*a* of the damper-side clutch piece 91, and only the movement member 96 is driven toward the damper 75 by the mating between the male screw 96*a* and the female threads 95*b*. After the predetermined number of rotations and the end of the movement member 96 reaches a stopper 75*d* of the damper 75, as is understood from FIGS. 16 and 17, the movement member 96 stops in situ and the clutch piece 95 is driven in a direction away from the damper 75.

In contrast, when the winding shaft 6 rotates in a screen winding direction, the clutch piece 95 is driven from the state shown in FIG. 17 to the position shown in FIG. 16 by the mating between the male screw 96*a* and the female threads 95*b* so that the clutch tooth 95*a* of the clutch piece 95 engages with the clutch tooth 91*a* of the damper-side clutch piece 91. In the rotation thereafter, the movement member 96 is driven in a direction separating away from the damper-side clutch piece 91 as shown in the deployment to be the state shown in FIG. 15.

Thereafter, the rotation of the winding shaft 6 is transmitted to the casing of the oil damper 75 via the clutch piece 95 and the clutch piece 91 mated with the clutch piece 95. Since the rotation shaft 75*a* of the oil damper 75 is fixed to the bracket of the winding box by the fixed shaft 67, the damper 75 functions so as to apply a braking force to the winding shaft 6.

As is understood from the description above, the spirally operating mechanism 97 disposed between the movement member 96 and the fixed shaft 67 moves the movement member 96 and the clutch piece 95 relative to the fixed shaft 67 from the state shown in FIG. 15 to the state shown in FIGS. 16 and 17 once deployment starts. Thereafter, the clutch piece 95 is moved in a direction away from the clutch piece 91, while when retracting the screen, the clutch piece 95 is inversely operated. Therefore, during winding the screen 7, when the clutch piece 95 is not separated from the clutch piece 91 (FIGS. 15 and 16), when starting to wind the screen 7, the clutch pieces 91 and 95 are simultaneously connected together so as to operate the damper 75. When both the clutch pieces 91 and 95 are separated from each other (FIG. 17), the movement member 96 is moved toward the damper 75 by the winding of the screen 7 together with the clutch piece 95, and after the clutch piece 95 abuts the clutch piece 91, the damper 75 is operated until the completion of winding of the screen 7.

In addition, to a coupling shaft 75*e* disposed in the casing of the damper 75, a fixed shaft (see FIGS. 8 and 14) of a winding spring disposed in the bracket of the winding box may be connected if required. However, if the fixed shaft is connected, the second embodiment, it is necessary that an idling region without a thread is provided on the male screw 96*a* of the movement member 96 for idling the clutch piece 95 in situ while the rotational urging force of the coil spring can be adjusted by the rotation of the fixed shaft around the bracket of the winding box.

The other structures and operations of the automatic winding screen device according to the fifth embodiment are substantially the same as those according to the third embodiment, so that like reference numerals designate like element common or equivalent thereto, and the description is omitted.

What is claimed is:

1. An automatic winding screen device, comprising:

a winding box having a bracket at an end thereof;

a winding shaft having a first spring support seat and a clutch support seat disposed therein and attached thereto, the winding shaft being configured to roll and unroll a screen on a surface thereof and being rotatably supported by the winding box;

a fixed shaft having first and second ends and a second spring support seat, the first end of the fixed shaft being connected to the bracket;

a coil spring having first and second ends, the coil spring being disposed inside the winding shaft and having the first and second ends connected to the first and second spring support seats, respectively;

a one-way clutch mechanism having damper-side and winding-shaft clutch pieces, the winding-shaft clutch piece being disposed on the clutch support seat; and a damper disposed within the winding box on the second end of the fixed shaft between the first spring support seat and the clutch support seat, a damper shaft being connected to the damper-side clutch piece, wherein the one-way clutch mechanism is configured to disconnect the damper from the winding shaft when the screen is unrolled from the winding shaft and to connect the damper to the winding shaft when rolling the screen over the winding shaft at least during a later stage of rolling the screen over the winding shaft.

2. A device according to claim 1, wherein the winding shaft-side clutch piece is configured to integrally rotate with the winding shaft and also slidable along the axial direction of the winding shaft, wherein, between the clutch pieces, clutch teeth are disposed, the clutch teeth being disengaged from each other when the winding shaft is rotated in a screen deployment direction while being engaged to each other when the winding shaft is rotated in a screen winding direction, and wherein urging means is provided for urging the winding shaft-side clutch piece to the damper-side clutch piece so that both clutch teeth are engaged with each other.

3. A device according to claim 1, wherein a spirally operating mechanism is disposed between the clutch pieces, the winding shaft-side clutch piece is configured to integrally rotate with the winding shaft and also slidable along the axial direction of the winding shaft, wherein, in the spirally operating mechanism, the winding shaft-side clutch piece rotates about the support shaft, the winding shaft-side clutch piece being driven in a direction separating from the damper-side clutch piece following the rotation of the winding shaft when the winding shaft is rotated in a screen deployment direction while being driven in a direction approaching the damper-side clutch piece when the winding shaft is rotated in a screen winding direction, and wherein both clutch pieces are provided with clutch teeth which are engaged with each other when the clutch pieces abut each other.

4. A device according to claim 3, wherein the spirally operating mechanism comprises screws and threads engaged with each other and respectively disposed in a support shaft on the damper side clutch piece and in the winding shaft-side clutch piece.

5. A device according to claim 4, wherein the spirally operating mechanism disposed between the winding shaft-side clutch piece and the support shaft is configured to drive the winding shaft-side clutch piece toward the damper-side clutch piece from a screen winding starting point until a time that the damper is operated by engagement of the clutch pieces so as to reduce a winding speed of the screen, and wherein, on the support shaft, an idling region is disposed for idling the winding shaft-side clutch piece relative to the support shaft in situ when the winding shaft-side clutch piece reaches an end of an operational range of the spirally operating mechanism during deployment of the screen.

6. A device according to claim 5, further comprising urging means for urging the winding shaft-side clutch piece disposed in the idling region on the support shaft to the spirally operating mechanism.

7. A device according to claim 5 or 6, wherein a length of the support shaft is adjustable relative to the damper-side clutch piece so that the time that the damper is operated is adjustable.

8. A device according to claim 1, wherein the winding shaft-side clutch piece is configured to integrally rotate with the winding shaft and also slidable along the axial direction of the winding shaft, a clutch spring for urging both the clutch pieces in an engaging direction, and clutch time difference operating means for keeping the clutch pieces engaged while the winding shaft rotates by a predetermined number of rotations from a full wound state when the screen is opened, and then for disengaging the clutch pieces against an urging force of the clutch spring.

9. A device according to claim 8, wherein the clutch time difference operating means comprises a movement member movable relative to the winding shaft-side clutch piece in the axial direction of the fixed shaft so as to rotate the clutch piece and the movement member integrally with the winding shaft and also slidably in the axial direction and a clutch spring interposed therebetween so as to connect the movement member to the fixed shaft by a spirally operating mechanism, and wherein, in the spirally operating mechanism, the movement member is driven in a direction away from the damper in a state that both the clutch pieces are mated with each other during initial predetermined rotations when the winding shaft is rotated in screen deployment a direction, and after the predetermined number of rotations, the spirally operating mechanism is driven in a direction that the winding shaft-side clutch piece and the movement member are integrally moved toward the damper-side clutch piece, while when the winding shaft is driven in a screen winding direction, the spirally operating mechanism is driven in a direction that the winding shaft-side clutch piece and the movement member integrally approach the damper-side clutch piece, and after the predetermined number of rotations and after both the clutch pieces are mated with each other, only the movement member is driven toward the damper-side clutch piece.

10. A device according to claim 9, wherein the spirally operating mechanism comprises screws and threads engaged with each other and disposed in the fixed shaft and the movement member, respectively.

11. A device according to claim 9, wherein a slidable range between the winding shaft-side clutch piece and the movement member defines an operation range of the damper at a later stage of winding of the screen.

12. A device according to any one of claims 9 to 11, wherein the coil spring is disposed between the fixed shaft disposed in the bracket of the winding box and the spring support seat disposed in the winding shaft, the rotational urging force of the coil spring is adjustable by the rotation of the fixed shaft relative to the bracket and the damper is provided between the fixed shaft and the winding shaft, wherein the spirally operating mechanism disposed between the movement member and the fixed shaft is configured to drive the winding shaft-side clutch piece toward the damper-side clutch piece from a point where screen winding starts until a time that the damper is operated by the engagement of the clutch pieces so as to reduce a winding speed of the screen, and wherein, on the support shaft, an idling region is disposed for idling the winding shaft-side clutch piece relative to the support shaft in situ when the winding shaft-side clutch piece reaches an end of an operation range of the spirally operating mechanism during deployment of the screen.

13. A device according to claim 8, wherein the one-way clutch comprises a threaded winding shaft-side clutch piece, the winding shaft-side clutch piece is configured to rotate integrally with the winding shaft and also to slide along the axial direction of the winding shaft; threads disposed on an external periphery of the mechanism threaded to the winding shaft-side clutch piece; a movement member slidable in the axial direction of the fixed shaft and sliding while being restrained to rotate; and a clutch spring for urging the movement member to the damper.

* * * * *